US006307158B1

(12) United States Patent
Kashima et al.

(10) Patent No.: US 6,307,158 B1
(45) Date of Patent: Oct. 23, 2001

(54) CLIP STRUCTURE FOR EXTRACTING ELECTRIC SIGNALS

(75) Inventors: Isao Kashima; Rumiko Kashima, both of Kokubunji (JP)

(73) Assignee: Mechano Electronic, Inc., Tokyo (JP)

( * ) Notice: Subject to any disclaimer, the term of this patent is extended or adjusted under 35 U.S.C. 154(b) by 0 days.

(21) Appl. No.: 09/472,948

(22) Filed: Dec. 27, 1999

(30) Foreign Application Priority Data

Aug. 11, 1999 (JP) ..... 11-227664

(51) Int. Cl.[7] ..... H01B 17/20

(52) U.S. Cl. ..... 174/194; 174/167; 174/168; 174/180; 174/197; 361/668; 361/671

(58) Field of Search ..... 174/194, 167, 174/168, 176, 180, 185, 197; 361/671, 664, 668

(56) References Cited

U.S. PATENT DOCUMENTS 3,616,066 * 10/1971 Rainey ..... 156/436
5,484,305 * 1/1996 Diniz et al. ..... 439/421

* cited by examiner

*Primary Examiner*—Dean A. Reichard
*Assistant Examiner*—W. David Walkenhorst
(74) *Attorney, Agent, or Firm*—Oliff & Berridge, PLC.

(57) ABSTRACT

A clip structure for extracting electric signals for measurement, which is improved in accuracy and reliability, and which can be handled easily. In the clip structure, an operating member is rotatably supported in a hollow base member with one end projecting from the base member, and urged in a specified direction. A cylindrical member is provided at the front end of the base member. Elastic wires are stored in the cylindrical member and grip portions are formed in the front portions of the elastic wires, while the rear portions are fixed to a lower portion of the operating member. The grip portions are configured to project from the front end of the cylindrical member when pushed in a direction opposite to an urging force and rotated. A contact pin member is disposed at a lower portion of the base member. One end of the contact pin member is engaged with the rear end of the cylindrical member while the other end is projected from the base member. The portion where the one end of the contact pin member and the rear end of the cylindrical member engage with each other is connected by welding such as soldering. A core material such as steel is inserted into the contact pin member.

1 Claim, 3 Drawing Sheets

CLIP STRUCTURE FOR EXTRACTING ELECTRIC SIGNALS

BACKGROUND OF THE INVENTION

The present invention relates to a clip structure for measurement, and particularly to a clip structure which can easily extract electric signals from circuit portions of electronic/electrical apparatus when such apparatus is subjected to inspection, adjustment, repair, etc.

Recently, as integration and sensitivity are improved in electronic/electrical apparatus, there are proposed various clip structures for extracting electric signals for measurement from circuit portions of such apparatus when the apparatus is subjected to inspection, adjustment, repair, and so on.

However, such a clip structure for extracting electric signals has problems as follows. Since a cylindrical member provided at a front end of a base member and a pin member disposed in a lower portion of the base member are connected to each other through a conductor, the resistance appearing here becomes large, and measured values are not stable so that reliable results of measurement cannot be obtained. Further, since the clip per se is very small, the clip has a difficulty in handling.

SUMMARY OF THE INVENTION

It is therefore an object of the present invention to solve the foregoing problems, and to provide a clip structure for extracting electric signals for measurement, which is improved in accuracy and reliability in measured values, and which can be handled easily and conveniently.

In order to achieve the above object, according to an aspect of the present invention, there is provided a clip structure for extracting electric signals, which comprises: a nonconductive and hollow base member; a nonconductive operating member rotatably supported in the base member so that one end of the operating member projects out from the base member, the operating member being urged in a return direction by an urging force applied thereto; a conductive cylindrical member provided at a front end of the base member so as to project straight; conductive elastic wires stored in the cylindrical member, the wires having front portions provided with grip portions and having rear portions fixed to a lower portion of the operating member, the grip portions being configured to be able to project from a front end of the cylindrical member when the operating member is pushed against the urging force and rotated; a conductive contact pin member disposed at a lower portion inside the base member, one end of the contact pin member being engaged with a rear end of the cylindrical member, the other end of the contact pin member being projected out from the base member, an engagement portion between the one end of the contact pin member and the rear end of the cylindrical member being connected by welding means such as soldering or the like; and a core material such as steel inserted into the contact pin member.

DETAILED DESCRIPTION OF THE PREFERRED EMBODIMENT

An embodiment of the present invention will be described below with reference to the drawings.

Figure 1:
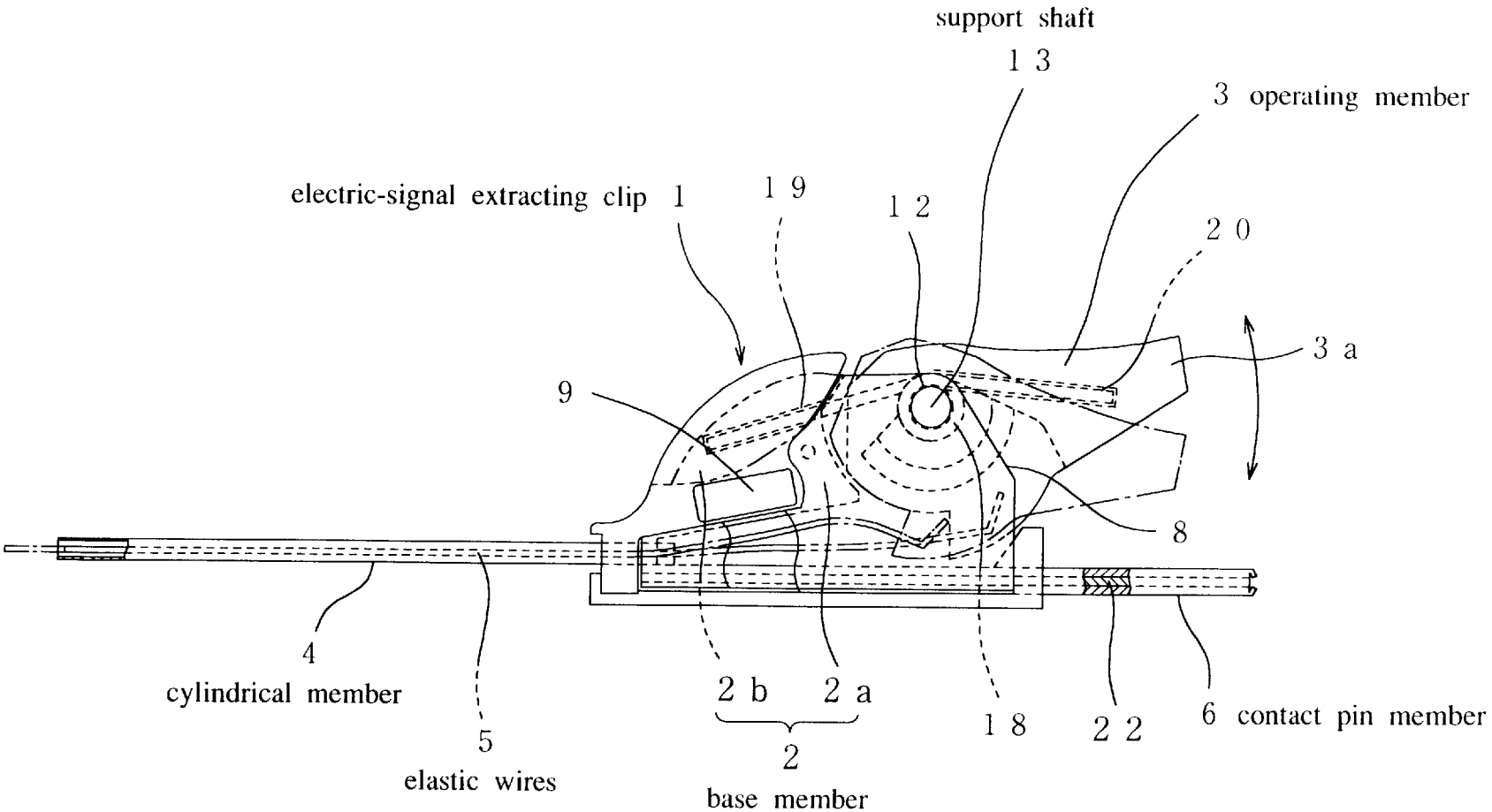
FIG. 1 is an explanatory view showing an internal structure of a clip to which a clip structure for extracting electric signals according to the present invention is applied.

FIG. 1 illustrates a clip 1 to which a clip structure for extracting electric signals according to the present invention is applied. This clip 1 is constituted mainly by a base member 2; an operating member 3 disposed in this base member 2 and having an end 3*a* projecting from an upper portion to a side portion of the base member 2; a cylindrical member 4 provided at a front end of the base member 2 so as to project therefrom; elastic wires 5 stored in this cylindrical member 4; and a contact pin member 6 disposed at a lower portion of the base member 2.

Figure 2:
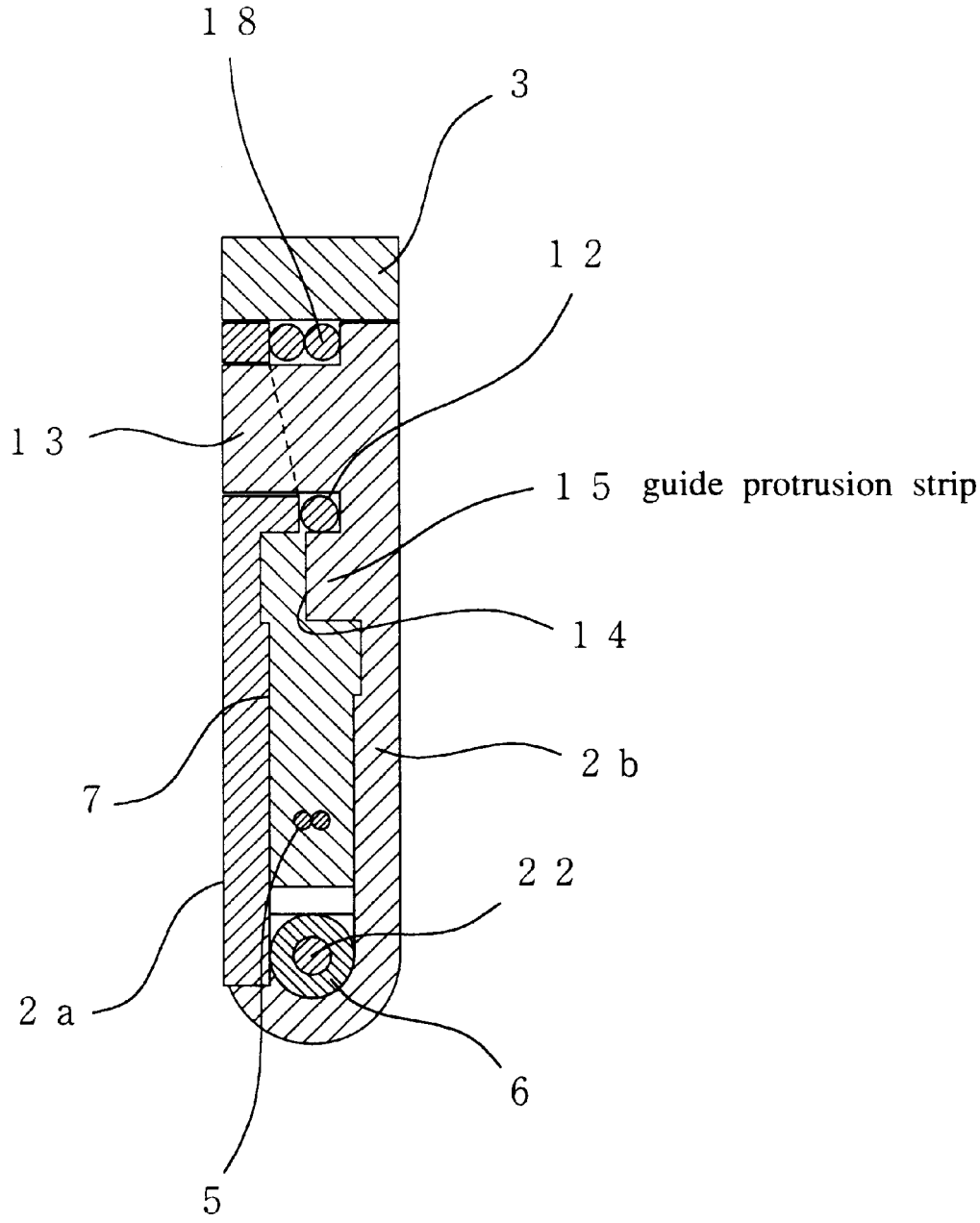
FIG. 2 is a vertically sectional view of a main part of the clip of FIG. 1.

As shown in FIGS. 1 and 2, in the base member 2, a hollow portion 7 is formed between a surface member 2*a* and a back member 2*b* which are made from synthetic resin and fixed to each other by bonding means such as a bonding agent or the like. An aperture portion 8 is formed so as to be opened from the upper side of the hollow portion 7 to the rear side of the same. In addition, the cylindrical member 4 is formed of a conductive material and provided in a lower portion of the front end surface of the base member 2 so as to project straight. The two thin elastic wires 5 consisting of conductive piano wires are stored in this cylindrical member 4.

In the base member 2, a rectangular bar insertion hole 9 is provided near a front portion of the base member 2 so as to penetrate the base member 2 from one side to the other side. When a large number of clips 1 are put side by side so as to be used with together, a bar (not shown) is inserted into this bar insertion hole 9 so that these clips 1 are locked with each other by the bar and prevented from rattling.

The material of the base member 2 is not always limited to resin, so long as the material is a nonconductive one. In addition, the elastic wires 5 are not limited to piano wires.

Next, the operating member 3 made from synthetic resin is disposed in the hollow portion 7 of the base member 2 so as to project partially from the inside of this hollow portion 7. That is, this operating member 3 is supported by a support shaft 13 which is provided integrally with and projecting from the upper back surface of the back member 2*b* forming the base member 2 and which is fitted into a shaft hole 12 provided substantially in an upper central portion of the operating member 3, as shown in FIGS. 1 and 2.

In a condition where the operating member 3 is rotatably supported by the support shaft 13 in the base member 2 as mentioned above, a guide protrusion strip 15 provided so as to be integrated with and projected from the back surface of the back member 2*b* on the circumference of a circle with the support shaft 13 as its center is fitted into a guide recess strip 14 which is provided in a side surface of the operating member 3 on the circumference of a circle with the shaft hole 12 as its center. In such a manner, the operating member 3 disposed in the base member 2 is supported at two places, so that the operating member 3 can be rotated surely and smoothly when the operating member 3 is pushed. The operating member 3 is also superior in strength.

As shown in FIG. 1, a coil spring 18 is fitted between the support shaft 13 provided on the back member 2*b* and the shaft hole 12 provided in the operating member 3 which is rotatably supported on the supporting shaft 13. One end of the coil spring 18 is fitted into a receiving groove 19 provided in the base member 2 while the other end is fitted into a receiving groove 20 provided in the operating member 3. One end 3*a* of the operating member 3 is normally urged upward by the spring force of the coil spring 18.

Figure 3:
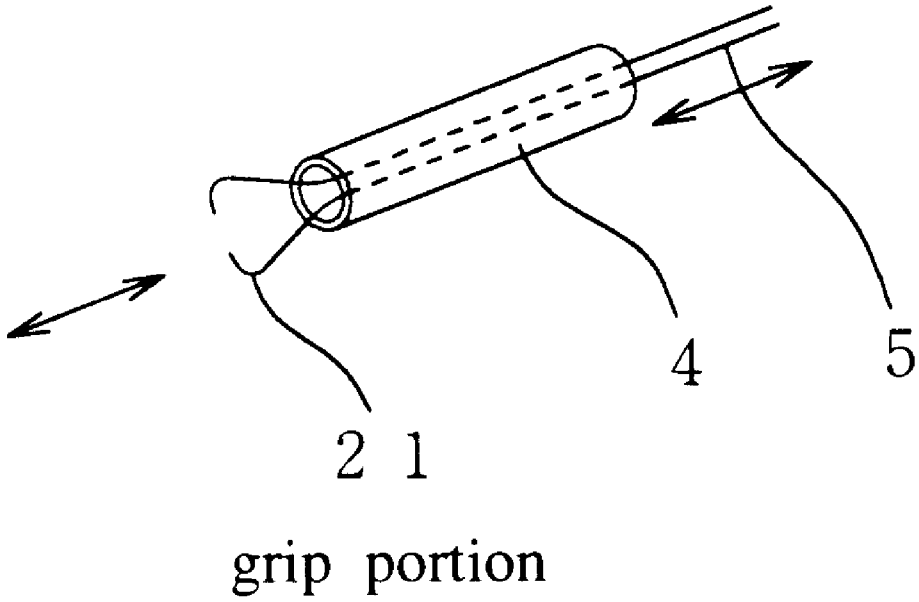
FIG. 3 is a perspective view of a main part of the clip, showing a state where grip portions project out from a front end of a cylindrical member of the clip.

Next, grip portions 21 are provided integrally with front portions of the two elastic wires 5 stored in the cylindrical member 4. This grip portions 21 are formed by bending the front portions of the elastic wires 5 inward as shown in FIG. 3. On the other hand, rear portions of the elastic wires 5 are buried in a lower portion of the operating member 3. By pressing the one end 3*a* of the operating member 3 down so as to rotate the operating member 3, the grip portions 21 provided in the front portions of the elastic wires 5 are projected out from the front end of the cylindrical member 4.

The conductive contact pin member 6 is disposed in a lower portion of the base member 2, and a core material 22 made of metal such as steel or the like is inserted into this contact pin member 6. In addition, one end of the contact pin member 6 is fixed by soldering in the state where the one end of the contact pin 6 is put on the rear end of the conductive cylindrical member 4 provided in the front portion of the base member 2, while the other end is made to project out from the rear portion of the base member 2.

A measuring instrument is connected through a lead wire (not shown) to the other end of the contact pin member 6 projecting out from the rear portion of the base member 2.

According to the electric-signal extracting clip 1 to which the electric-signal extracting clip structure configured thus is applied, when the one end 3*a* of the operating member 3 is pressed down against the elasticity of the coil spring 18 as shown in FIG. 1, the operating member 3 rotates around the support shaft 13 provided on the back member 2*b* forming the base member 2. In addition, the guide recess strip 14 formed in one side surface of the operating member 3 is fitted to the guide protrusion strip 15 provided integrally with the back surface of the back member 2*b* so that the guide recess strip 14 can slide on the guide protrusion strip 1 15. Accordingly, the operating member 3 can rotate smoothly. In addition, since the operating member 3 is supported at two places by the support shaft 13 and the guide protrusion strip 15, the operating member 3 is superior also in strength. Further, with this configuration this clip structure can be made small in size sufficiently.

In addition, with the rotation of the operating member 3, the two elastic wires 5 having their rear end portions buried in the lower portion of this operating member 3 are pushed forward so as to move in the cylindrical member 4 provided at the front end of the base member 2. At the same time, the grip portions 21 provided at the front ends of the two elastic wires 5 are projected out from the front portion of the cylindrical member 4.

Further, the grip portions 21 are opened by the elastic effect when the grip portions 21 are projected from the front portion of the cylindrical member 4. Then, the grip portions 21 opened thus are brought into contact with an electrode to be measured in a circuit portion of a measuring instrument (not shown). Then, when pressing force is removed from the operating member 3, the operating member 3 is returned to its original state by the spring force of the coil spring 18. At that time, the grip portions 21 will go into the cylindrical member 4. In this process, the grip portions 21 can grip the electrode to be measured so that electric signals to be measured can be extracted easily.

Furthermore, since the one end of the contact pin member 6 is fixed by soldering in the state where the one end of the contact pin member 6 overlaps with the rear end of the conductive cylindrical member 4 provided in the front portion of the base member 2, the conductor resistance of the contact pin member 6 is small so that it is possible to improve the accuracy of the values of measured electric signals obtained through the elastic wires 5 in the cylindrical member 4.

In addition, since the core material 22 made of metal such as steel or the like is inserted into the contact pin member 6, strength can be obtained. As a result, it is possible to perform the work of measuring in the state where the clip 1 is surely held with fingers while the contact pin member 6 and the operating member 3 are touched.

According to a clip structure for extracting electric signals configured thus according to the present invention, an operating member disposed in a base member is supported rotatably in the up/down direction by a support shaft provided in the base member and a guide protrusion strip provided on the circumference of a circle with this support shaft as its center. Therefore, the operating member can be rotated smoothly. In addition, since the clip structure is superior in strength, it is possible to reduce the size of the clip.

In addition, with the rotation of the operating member, elastic wires having their rear end portions fixed to the lower portion of this operating member move in a cylindrical member so that grip portions provided at the front ends of the elastic wires project out from the front portion of the cylindrical member. Therefore, the grip portions can grip an electrode to be measured surely.

Further, a conductive pin member is disposed at the lower portion of the base member. One end of this pin member is engaged with the cylindrical member while the other end thereof is made to project out from the base member. Therefore, if a measuring instrument is connected to the other end of the pin member through a lead wire, it is possible to easily extract or measure electric signals from the electrode to be measured which is gripped by the grip portions.

Furthermore, the one end of the contact pin member is fixed by welding means such as soldering in the state where the one end of the contact pin member is put on the rear end of the conductive cylindrical member provided in the front portion of the base member. Therefore, the conductor resistance of the contact pin member is small so that it is possible to improve the accuracy of the measured values of the electric signals obtained through the elastic wires in the cylindrical member.

In addition, a core material made of metal such as steel or the like is inserted into the contact pin member. Accordingly, strength can be enhanced, so that it is possible to perform the work of measurement in the state where the clip is surely held with fingers while the contact pin member and the operating member are touched. In addition, the clip is convenient in handling.

What is claimed is:

1. A clip structure for extracting electric signals, comprising:

a nonconductive and hollow base member;

a nonconductive operating member rotatably supported in said base member so that one end of said operating member projects out from said base member, said operating member being urged in a direction by an urging force applied thereto;

a conductive cylindrical member provided at a front end of said base member so as to project straight;

conductive elastic wires stored in said cylindrical member, said wires having front portions provided with grip portions and having rear portions fixed to a lower portion of said operating member, said grip portion being configured to be able to project from a front end of said cylindrical member when said operating member is pushed in a direction opposite said urging force and rotated;

a conductive contact pin member disposed at a lower portion inside said base member, one end of said contact pin member being engaged with a rear end of said cylindrical member, the other end of said contact pin member being projected out from said base member, an engagement portion between said one end of said contact pin member and said rear end of said cylindrical member being connected by a welding means and a core material inserted into said contact pin member.

* * * * *